US008963080B2

(12) United States Patent
Nyman et al.

(10) Patent No.: US 8,963,080 B2
(45) Date of Patent: Feb. 24, 2015

(54) SUBSTRATE COMPOSITIONS AND METHODS OF USE THEREOF

(76) Inventors: Michael Charles Nyman, San Diego, CA (US); Matthew Paul Greving, San Diego, CA (US); Joseph Cohen, Encinitas, CA (US)

( * ) Notice: Subject to any disclaimer, the term of this patent is extended or adjusted under 35 U.S.C. 154(b) by 0 days.

(21) Appl. No.: 13/374,909

(22) Filed: Jan. 23, 2012

(65) Prior Publication Data

US 2012/0187287 A1 Jul. 26, 2012

Related U.S. Application Data

(60) Provisional application No. 61/461,690, filed on Jan. 22, 2011.

(51) Int. Cl.
*H01J 49/26* (2006.01)
*H01J 49/04* (2006.01)

(52) U.S. Cl.
CPC ..... *H01J 49/0418* (2013.01)
USPC ..... 250/288; 250/281; 250/282

(58) Field of Classification Search
USPC ..... 250/288
See application file for complete search history.

(56) References Cited

U.S. PATENT DOCUMENTS

| | | | | |
|---|---|---|---|---|
| 5,872,010 | A * | 2/1999 | Karger et al. | 436/173 |
| 6,707,038 | B2 * | 3/2004 | Ellson et al. | 250/288 |
| 6,794,196 | B2 * | 9/2004 | Fonash et al. | 436/174 |
| 6,873,914 | B2 * | 3/2005 | Winfield et al. | 702/19 |
| 2004/0026615 | A1 * | 2/2004 | Ellson et al. | 250/288 |

OTHER PUBLICATIONS

Eisen et al "Cluster Analysis and display of genome-wide expression patterns", Proc. Natl. Acad. Sci. USA 95 (1998) p. 14865.*

* cited by examiner

*Primary Examiner* — Phillip A Johnston

(57) ABSTRACT

The subject matter provided herein relates to substrates for desorbing and ionizing analytes, and kits and methods of use thereof. The substrate provided herein comprises a porous semiconductor, a fluorous initiator, and a photoactive compound containing a fluorous group.

9 Claims, 8 Drawing Sheets

SUBSTRATE COMPOSITIONS AND METHODS OF USE THEREOF

RELATED APPLICATIONS

This application claims priority to U.S. provisional application No. 61/461,690, filed Jan. 22, 2011, the disclosure of which is incorporated by reference herein in its entirety.

FIELD

The subject matter provided herein relates to substrates for desorbing and ionizing analytes, and kits and methods of use thereof. The substrate provided herein comprises a porous semiconductor, a fluorous initiator, and a photoactive compound containing a fluorous group.

SUMMARY

Provided herein are various aspects of a desorption ionization mass spectrometry platform technology that is capable of high-throughput, high-content, label-free mass-based analysis of microvolume quantities of sample. One feature of this technology is that it capable of rapidly detecting and analyzing thousands of compounds present in a complex mixture and is available as a powerful tool for the study of biological systems.

DETAILED DESCRIPTION

Figure 1:
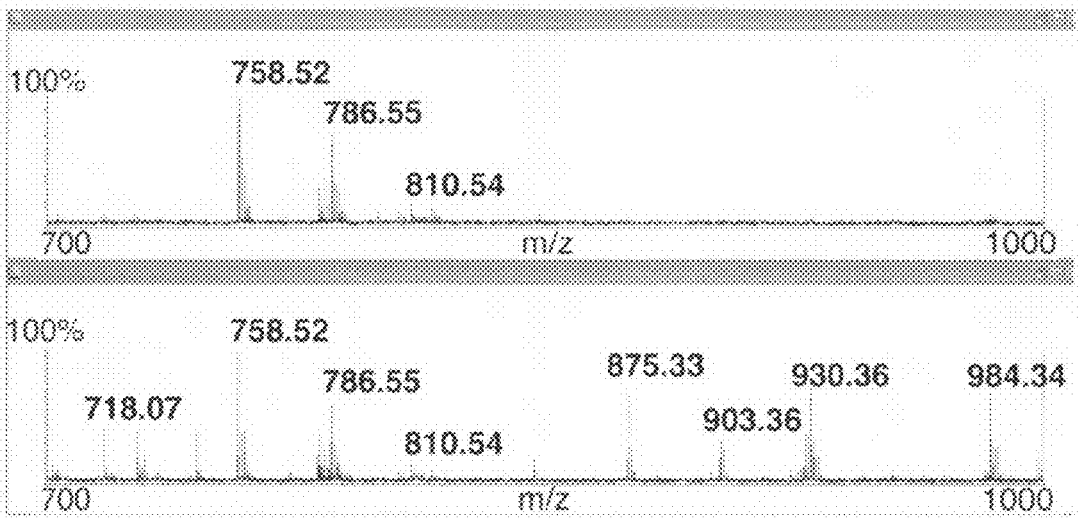
FIG. 1 is a spectral comparison of blood sample detected on a substrate with (bottom spectra) and without (top spectra) photoacid treatment of the substrate showing enhancement of the ionization peaks detected with the photoacid treatment.

The following embodiments provided herein are exemplary and are not limitations. The substrate, methods and kits disclosed herein have a range of applications, all of which are based on the ability to detect, quantify, or isolate analyte using desorption ionization mass spectrometry.

The Substrate and its Preparation

Provided herein in one embodiment is a substrate comprising a porous semiconductor treated with a fluorous initiator and a photoactive compound, which treatment enhances the ionization and desorption of samples deposited on its surface thereby enhancing the detection of the sample by desorption ionization MS analysis. The porous semiconductor provided herein absorbs electromagnetic radiation which is used to ionize the analyte that rests upon or is adsorbed on the substrate. In one embodiment, provided herein is a substrate comprising a porous semiconductor, a fluorous initiator adsorbed to the semiconductor and a photoactive compound containing a fluorous group adsorbed to the semiconductor. In another embodiment, provided herein is a substrate comprising a porous semiconductor, a fluorous initiator, and a photoactive compound containing a fluorous group. The fluorous initiator is a molecule that adsorbs onto or coats the substrate and in certain cases, adsorbs onto or coats the recesses of the porous substrate, and is believed to thereby trap or sequester the analyte that rests upon or is adsorbed on the substrate. The fluorous initiator vaporizes upon irradiation of the substrate (for example with a laser or ion beam) and is believed to facilitate the desorption of the analyte.

As used herein, the term "adsorb", "adsorbed" or "adsorption" as applied to a molecule, sample, or analyte in a sample, means that the molecule, sample or analyte is resting upon or in contact with a surface. As used herein, the term "desorb", "desorbed" or "desorption" as applied to a molecule, sample, or analyte in a sample, means that the molecule, sample or analyte is removed from the surface that it is contacting.

In certain embodiments, the semiconductor is selected from silicon, doped silicon, aluminum, polymeric resins, silicon dioxide, doped silicon dioxide, silicon resins, gallium, gallium arsenide, silicon nitride, tantalum, copper, polysilicon, ceramics, and aluminum/copper mixtures. In yet another embodiment, the semiconductor is selected from silicon, doped silicon, silicon dioxide and doped silicon dioxide. In yet another embodiment, the semiconductor is silicon or doped silicon. In one embodiment, the semiconductor is a boron-doped p-type silicon. In another embodiment, the semiconductor is phosphorous-doped n-type silicon. In yet another embodiment, the semiconductor is arsenic-doped silicon.

As used herein, the term "porous" means having "pores", or having recesses or void spaces. In certain embodiments, the recesses are channels, wells or pits. The recesses may have a random or ordered orientation or pattern. In certain embodiments, the recesses or void spaces have a degree of irregularity. The semiconductor may be rendered porous by any chemical and physical methods known to those of ordinary skill in the art, including etching, drilling and scratching. The semiconductor may be rendered porous by other methods including sintering, lithography, sputtering, sol-gel preparation and other methods known to those of ordinary skill in the art. In certain embodiments, the porous semiconductor substrate has pores having a degree of irregularity mostly having a diameter of about 5 nm to about 20 nm. In certain embodiments, the porous semiconductor substrate has pores having a degree of irregularity mostly having a diameter of about 10 nm.

In certain embodiments, the porous semiconductor substrate comprises a fluorous initiator. In one embodiment, the fluorous initiator is a fluorous siloxane or fluorous silane. In one embodiment, the fluorous initiator is a fluorous siloxane.

In one embodiment, the fluorous initiator is a fluorinated polysiloxane. In one embodiment, the fluorous initiator is selected from poly(3,3,3-trifluoropropylmethylsiloxane), bis(tridecafluoro-1,1,2,2-tetrahydrooctyl)tetramethyldisiloxane, heptadecafluoro 1,1,2,2-tetrahydrodecyl)dimethylchlorosilane, bis(tridecafluoro-1,1,2,2-tetrahydrooctyldimehtylsiloxy)-methylchlorosilane, and bis(heptadecafluorodecyl)-tetramethyldisiloxane. In another embodiment, the fluorous initiator is selected from poly(3,3,3-trifluoropropylmethylsiloxane), bis(tridecafluoro-1,1,2,2-tetrahydrooctyl)tetramethyldisiloxane and bis(heptadecafluorodecyl)-tetramethyldisiloxane. In one embodiment, the fluorous initiator is bis(heptadecafluorodecyl)-tetramethyldisiloxane.

In certain embodiments, the method of preparing the porous semiconductor substrate comprises: (1) etching the semiconductor to make a porous surface and (2) contacting the porous surface with a fluorous initiator and a photoactive compound. In one embodiment, the fluorous iniator and photoactive compound is contacted as a mixture to the porous surface. In yet another embodiment, the fluorous initiator is contacted with the porous surface before the photoactive compound is contacted with the porous surface. In yet another embodiment, the photoactive compound is contacted with the porous surface before the fluorous initiator is contacted with the porous surface.

In certain embodiments, the method of preparing the porous semiconductor substrate further comprises the step exposing the substrate to acidic vapor, basic vapor or volatile compounds that specifically react with certain functional groups. Gas-phase chemical modification of the substrate before or after sample deposition occurs in a diffusional manner that maintains the addressability and discreteness of the samples deposited on the surface. The exposure of the substrate to acidic or basic vapor was found to enhance detection of the analyte in both positive and negative mode ionization. Exposure of the substrate to volatile reactive reagents in the gas-phase was found to enhance the detection of classes of compounds having specific functional groups.

In one embodiment, the acidic vapor is selected from TFA, hydrochloric acid and sulfuric acid. In one embodiment, the basic vapor is selected from ammonium hydroxide and ammonium fluoride. In one embodiment, the volatile compounds are compounds that selectively modify functional groups selected from ketones, carboxylic acids, sugars, phosphate groups, thiols and amino groups. In another embodiment, the volatile compounds selectively modify ketones, carboxylic acids and amino groups. In another embodiment, the volatile compounds are selected from O-(2,3,4,5,6-pentafluorobenzyl)hydroxylamine, 1,2-phenylenediamine and methyl isothiocyanate. In yet another embodiment, the acidic vapor the basic vapor or the volatile compounds that react with functional groups, are selected such that their ionization product does not fall within the mass range being detected.

In one embodiment, the photoactive adsorbate is a photoactive compound containing a fluorous group. In certain embodiments, the photoactive compound is an acid which was found to enhance the analysis of the analyte in positive mode ionization, serving as a proton donor upon irradiation. In certain embodiments, the photoactive adsorbate containing a fluorous group is selected from (4-Bromophenyl)diphenylsulfonium triflate, (4-Chlorophenyl)diphenylsulfonium triflate, (4-Fluorophenyl)diphenylsulfonium triflate, (4-Iodophenyl)diphenylsulfonium triflate, (4-Methoxyphenyl) diphenylsulfonium triflate, (4-Methylphenyl) diphenylsulfonium triflate, (4-Methylthiophenyl)methyl phenyl sulfonium triflate, (4-Phenoxyphenyl)diphenylsulfonium triflate, (4-Phenylthiophenyl)diphenylsulfonium triflate, (4-tert-Butylphenyl)diphenylsulfonium triflate, (tert-Butoxycarbonylmethoxynaphthyl)-diphenylsulfonium triflate, 1-Naphthyl diphenylsulfonium triflate, 2-(4-Methoxystyryl)-4,6-bis(trichloromethyl)-1,3,5-triazine, Bis(4-tert-butylphenyl)iodonium p-toluenesulfonate, Bis(4-tert-butylphenyl)iodonium perfluoro-1-butanesulfonate, Bis(4-tert-butylphenyl)iodonium triflate, Boc-methoxyphenyldiphenylsulfonium triflate, Diphenyliodonium hexafluorophosphate, Diphenyliodonium nitrate, Diphenyliodonium p-toluenesulfonate, Diphenyliodonium perfluoro-1-butanesulfonate, Diphenyliodonium triflate, N-Hydroxynaphthalimide triflate, N-Hydroxy-5-norbornene-2,3-dicarboximide perfluoro-1-butanesulfonate, Triarylsulfonium hexafluoroantimonate, Triarylsulfonium hexafluorophosphate, Triphenylsulfonium perfluoro-1-butanesulfonate, Triphenylsulfonium triflate, Tris(4-tert-butylphenyl)sulfonium perfluoro-1-butanesulfonate, Tris(4-tert-butylphenyl)sulfonium triflate and 5,10,15,20-Tetrakis(pentafluorophenyl) porphyrin. In yet another embodiment, the photoactive adsorbate is selected from triphenylsulfonium perfluoro-1-butanesulfonate, N-hydroxynaphthalimide triflate and 5,10,15,20-tetrakis(pentafluorophenyl) porphyrin. In yet another embodiment, the photoactive adsorbate yields an ionization product that does not have an ionized mass that falls within the mass range being detected. In yet another embodiment, the photoactive compound is a base. The photoactive bases were found to improve negative-mode ionization detection by serving as activate proton acceptors upon irradiation.

In yet another embodiment, provided herein is a substrate comprising a porous semiconductor, bis(heptadecafluorodecyl)-tetramethyldisiloxane adsorbed to the semiconductor and a photoactive compound containing a fluorous group adsorbed to the semiconductor selected from perfluoro-1-butanesulfonate, N-hydroxynaphthalimide triflate and 5,10,15,20-tetrakis(pentafluorophenyl) porphyrin.

In yet another embodiment, the substrate is a thermal insulating polymer containing thermally insulating microwells designed to confine the heat from the irradiation beam to the microwell. The thermally insulating microwell can hold a volume of sample and confines heat to the microwells in which the sample is contained. Thermally confined microwells may be generated using traditional lithographic methods in which the substrate surface is coated with thermally insulating materials and etched to form microwells.

In yet another embodiment, the substrate further comprises patterned electrodes, to which, after sample deposition, an electric potential may be applied thereby separating complex sample mixtures on the surface by their electrophoretic mobility, which can be further enhanced by changing pH, salt content, or applied voltages/polarity.

As used herein, the term "about" or "approximately" means within 20%, preferably within 10%, and more preferably within 5% (or 1% or less) of a given value or range.

In yet another embodiment, provided herein is a kit comprising a substrate comprising a porous semiconductor, a fluorous initiator adsorbed to the semiconductor and a photoactive compound adsorbed to the semiconductor. In another embodiment, the kit further comprises a UV-protective container.

Mass Spectrometry

In desorption/ionization mass spectrometry (MS), fast-moving electrons from an electron beam strike electrons in the analyte being studied or in the substrate on which the analyte rests, causing one or more electrons from the analyte to be ejected, rendering the analyte "ionized" or having a net positive charge. The ratio of the mass of the analyte molecule to the analyte's electron charge is measured and expressed as a m/z ratio value (referred to as mass to charge or mass to ionization ratio). In most cases, the ion usually has a single charge and the m/z ratio corresponds to the mass of the ion (i.e. its molecular weight). In some instances and as used herein, the terms m/z and the mass of the sample in Dalton units (Da) may be used interchangeably.

The desorption/ionization MS technology platform provided herein permits the label-free analysis of small molecule compounds, peptides, proteins, metabolites, biomolecules, cell lysates, whole cells, biofluids and tissues. The methods provided herein have high sensitivity across a biologically relevant mass range. In one embodiment, the mass range being detected is from about 70 to about 2000 Da. In one embodiment, the mass range being detected is from about 10 to about 2500 Da. In yet another embodiment, the mass range being detected is from about 2500 to about 50000 Da.

In certain embodiments provided herein, data acquisition is performed using a laser-desorption/ionization (LDI) mass spectrometer. MS instruments used herein include but are not limited to LDI-TOF, LDI-TOF-TOF, LDI-QTOF, LDI-QQQ, LDI-IMS-TOF, LDI-IMS-QTOF, LDI-IMS-QQQ. The instruments disclosed herein are capable of analyzing high-density libraries or samples printed on the substrate provided herein. Full m/z spectrum may be obtained for each sample or each analyte using the instruments disclosed herein. The instruments disclosed herein are able to resolve the masses of analytes that differ by less than 0.1 m/z. Ionization intensity may also be gathered for each analyte using the instrumentation disclosed herein.

Preferably the laser used emits in the ultraviolet range of the spectrum. In one embodiment, the laser source is nitrogen or Nd:YAG (frequency-tripled) laser-source.

Sample Deposition

In the embodiments provided herein, significant enhancement in sample ionization, desorption and detection, even of complex mixtures, has been be achieved by combining low volume deposition of sample droplets with use of the substrate provided herein which is also designed to enhance the ionization and desorption of the samples deposited on the surface. This highly focused sample droplet is particularly suited to the thermally-driven ionization process that occurs on the substrate during ionization desorption. Not wishing to be bound by theory, it is believed, nevertheless, that upon acoustic deposition of a sample droplet, the droplet, during flight, partially evaporates before making contact with the substrate. Again not wishing to be bound by theory, it is believed nevertheless that this rapid evaporation concentrates the analytes within the drop to metastable concentration levels to form a highly concentrated (with respect to the analyte concentration), focused spot having a diameter comparable to the diameter of the laser used for desorption. Such a highly concentrated spot would be difficult or impossible to achieve by direct application of the sample to the surface. It is further believed that because the analyte is highly focused and concentrated within the circumference of the ionization beam, and because the heat intensity is greatest at the center of the beam, the number of analytes exposed to the localized area of heat is maximized, resulting in an increase in the number of analytes that are desorbed and ionized upon irradiation.

Provided herein, in one embodiment, is a method for non-contact deposition of samples in volumes ranging from picoliter(s) to nanoliter(s) onto the substrate. The deposition may be a continuous surface coating or have micron scale separation. In certain embodiments, an acoustic dispenser is used to deliver samples in the single nanoliter (nL) to high picoliter (pL) range. In certain embodiments, the sample droplet size is no larger than the width of the ionization beam. Where the ionization beam is a laser beam having a diameter of approximately 40 microns, the sample droplet may be dispensed in the low nanoliter range to generate a droplet size comparable to the diameter of the laser. In certain embodiments, the laser diameter is from about 7 μm to about 10 μm, in which case the sample droplet is dispensed at a volume of from about 0.5 picoliters to about 1 nanoliter.

The term "non-contact" as used herein refers to a manner of sample deposition where no foreign surface other than the surface of the well or container holding the sample touches the sample during sample deposition. For example, no foreign surface such as a tip, pin or capillary device is used to transfer the sample in a non-contact sample deposition. In one embodiment, non-contact deposition is achieved using an acoustic liquid dispenser. Examples of acoustic liquid dispensers are ATS-100 by EDC Biosystems and the Echo series of liquid handlers by Labcyte, Inc.

In other embodiments, a sample volume of about 1 μL or less is applied to the substrate using a low-volume pipette or acoustic deposition. In another embodiment, a sample volume of less than about 1 μL is applied to the substrate. In another embodiment, a sample volume of about 0.1 to about 10 nL is applied to the substrate using acoustic deposition.

In one embodiment, provided herein is a method of detecting an analyte in a sample by desorption ionization mass spectrometry, comprising the steps of (1) depositing a sample having a volume in the picoliter to nanoliter range on a substrate, (2) delivering radiation to said sample to cause desorption and ionization of said sample and (3) detecting the mass-to-charge ratio of the ionized analyte. In one embodiment, the sample deposition step is a non-contact deposition step. In yet another embodiment, the sample deposition step is performed using an acoustic liquid dispenser. In another embodiment, the sample deposition step is performed using an acoustic liquid dispenser and the volume deposited is from about 1 nanoliter to about 5 nanoliters. In one embodiment, provided herein is a method of detecting an analyte in a sample by desorption ionization mass spectrometry, comprising the steps of (1) depositing a sample having a volume from about 1 nanoliter to about 5 nanoliters onto a substrate using non-contact deposition, (2) delivering radiation to said sample to cause desorption and ionization of said sample and (3) detecting the mass-to-charge ratio of the ionized analyte.

In one embodiment, provided herein is a method of detecting an analyte in a sample by desorption ionization mass spectrometry, comprising the steps of (1) depositing a droplet of sample, (2) delivering radiation to said sample to cause desorption and ionization of said sample and (3) detecting the mass-to-charge ratio of the ionized analyte. In one embodiment, the sample has a volume in the range of about 1 to about 5 nanoliters. In another embodiment, the radiation is from a laser source. In another embodiment, the laser source is an ultraviolet pulse laser source. In yet another embodiment, the ultraviolet pulse laser is a 337 nm pulsed nitrogen laser. In yet another embodiment, the laser source is a Nd:YAG (neodymium-doped yttrium aluminium garnet) laser source. In yet another embodiment, the laser source is a Nd:YAG laser source. In yet another embodiment, the radiation is from an ion beam source. In yet another embodiment, the ion beam is comprised of ions selected from the group consisting of $Bi_3^+$, $Bi^+$, $Au^+$ and $Ga^+$.

Algorithm for Data Analysis

One of the challenges of working with label-free samples or libraries printed on surfaces (such as the substrate provided herein) is that such label free samples or libraries usually not detectable, using optical methods or otherwise, and therefore locating or identifying significant features and aligning features between different substrates for comparison purposes is extremely difficult. One analytical approach to circumvent the problem is to use clustering and/or dimension reduction techniques to elucidate significant features or attributes from the collective data rather than identifying or analyzing discrete data points. Provided herein is a method of analyzing the spectral data and elucidating significant features or distinct attributes from the data using an algorithm comprising the following steps: (1) gathering all spectral data obtained from a surface or multiple surfaces, which are treated as independent measurements (2) identifying valid peaks in all spectra (using well-established peak detection methodologies such as wavelet-based spectral decomposition) and align them to a common axis to correct for slight peak shifts that may occur due to differences between substrates or differences between different areas of the same substrate, (3) normalizing aligned peaks to correct for overall signal intensity variation between individual spectra (for example using a global median intensity, total intensity, mean intensity, local median intensity or other applicable measures) (4) performing clustering analysis using one or more well established clustering and/or dimension reduction methods (for example, k-means clustering, singular value decomposition, multidimensional scaling, principle components analysis, self-organizing maps, learning algorithms or others) and (5) identifying a significant feature or distinct attribute (such feature or attribute may be, for example, compounds within a library with differing activity and/or mode of action, different cellular phenotypes within a library of cells or a cell-based screen, different organism phenotypes within a library of whole-organisms or an organism-based screen, different regions of cellular activity within a tissue on a surface, enzymes with differing activity).

The method may further comprise the step of mapping the statistically significant sets of features or attributes back to one or more regions on the original surface that contained the samples or libraries.

The algorithm above is useful in metabolomic or proteomic studies in which the metabolite profile or the protein profile of a cell, cell compartment, tissue or organism may be analyzed to generate a profile or fingerprint, of a disease state, for example, where the sample is obtained from a disease-specific cell line, diseased tissue or diseased organism. For example, a metabolite profile or fingerprint from a diseased specimen may be compared to a metabolite profile of a healthy specimen. Any detected increase or decrease in activity of a particular metabolic pathway or pathways could help identify the biological processes underlying a disease. Similarly, protein profiling of a disease state could lead to the identification of useful biomarkers for the disease.

The metabolic or protein profile that is generated, in combination with the data analysis algorithm above, may also be used to diagnose or classify diseases. Such a profile could be used to classify or define the disease at the molecular level and may permit early diagnosis, early treatment and personalized treatment of the disease based upon the profile.

The substrates, methods and kits provided herein may be used as tools in biomedical and biomolecular research. The substrates, methods and kits provided herein may be used to perform compound library analysis, enzymatic assay, cell based assay, drug distribution study, tissue profiling, tissue imaging, metabolic profiling studies, protein profiling studies, biofluid analysis, drug metabolite analysis and drug testing. The substrates, methods and kits provided herein have industrial applications, including the research and development of industrial enzymes and bacteria.

The following examples are intended to serve as illustrations of the invention and are not to be taken as a limitation of the invention.

EXAMPLES

The practice of the system and methods provided herein employs, unless otherwise indicated, conventional techniques in mass spectrometry and related fields as are within the skill of the art. These techniques are described in the references cited herein and are fully explained in the literature. See, e.g., Siuzdak, *Mass Spectrometry for Biotechnology* (1996) Elsevier Science, USA, Dass, *Fundamentals of Contemporary Mass Spectrometry* (2007) Wiley Interscience, Hoboken, N.J. Standard abbreviations and acronyms as defined in J. Org. Chem. 2007 72(1):23A-24A are used herein. Other abbreviations and acronyms used herein are as follows:

LDI—Laser-Desorption/Ionization

Mass spectrometry was performed on Applied Biosystems 5800 TOF-TOF. Acoustic dispensation was performed using ATS-100 from EDC Biosystems.

Example 1

Preparation of Substrate

P-type silicon wafers were cut to the desired dimensions and cleaned with ethanol followed by methanol and dried with a nitrogen gas stream. The silicon substrate was etched by acidic electrochemical etching for 30 minutes in a solution of 25% hydrofluoric acid in ethanol and a constant current of 300 mA. After etching, the silicon substrate was rinsed with water, then methanol and dried with a nitrogen gas stream and baked for 15 minutes at 100° C. A thin layer of bis(heptadecafluorodecyl)-tetramethyldisiloxane initiator solution containing one or more of the photoactive additives N-hydroxynaphthalimide triflate (500 μM), triphenylsulfonium perfluoro-1-butanesulfonate (500 μM) or 5,10,15,20-tetrakis (pentafluorophenyl) porphyrin (25 mM) were then added to the substrate for one hour, after which excess initiator was removed with a high flow stream of nitrogen gas. Either before or after sample deposition on the substrate, the surface was further modified with gas phase treatment using one of the following reagents: trifluoroacetic acid vapor, hydrochloric acid vapor, ammonium hydroxide vapor, ammonium fluoride vapor, O-(2,3,4,5,6-pentafluorobenzyl)hydroxylamine vapor, 1,2-phenylenediamine vapor, or methyl isothiocyanate vapor. The substrate can be stored for many weeks in a dry environment/chamber without loss of performance.

FIG. 1 is a spectral comparison of blood sample detected on a substrate with (bottom spectra) and without (top spectra) photoacid treatment of the substrate. The photoacid treatment significantly enhances the number of peaks detected.

Figure 2:
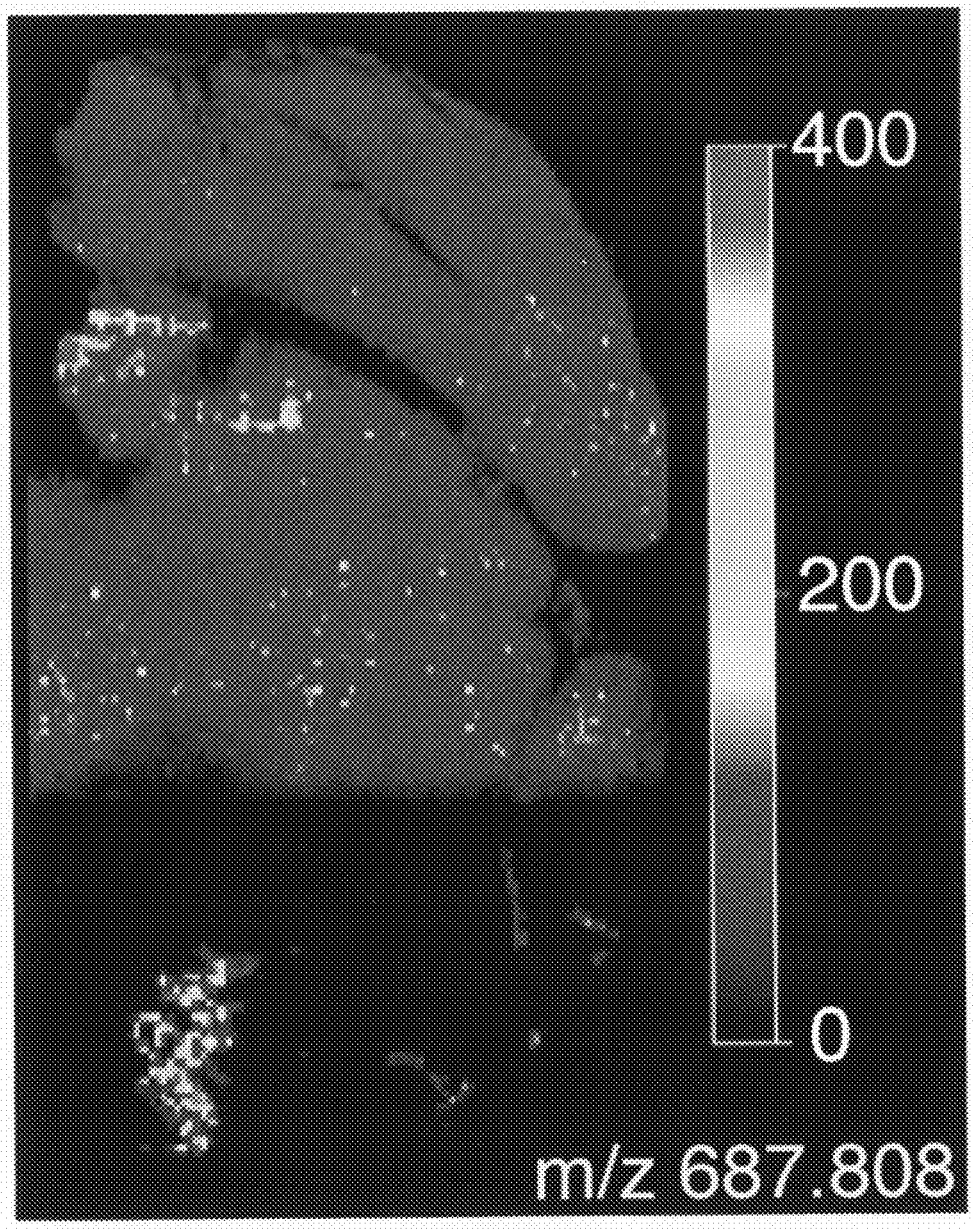
FIG. 2 shows tissue imaging of a mouse brain slice with and without photoacid treatment, showing significant enhancement of signal with photoacid treatment (top portion of sample) compared to no treatment (bottom portion of sample).

FIG. 2 is tissue imaging of a mouse brain slice with and without photoacid treatment. The top half of the brain slice was treated with photoacid and shows significant enhancement of signal compared to the bottom half of the sample that was not treated with photoacid.

Example 2

High-Throughput Analytical Characterization of Chemical Libraries 1280 compounds from a small molecule library were deposited on the substrate described in Example 1. The compounds had an initial concentration of 10 mM in ~70% DMSO/water. The compounds were diluted thirty-fold from a 384-well acoustic source plate to a 1536 acoustic source plate in 50% DMSO/Water. The plate was centrifuged at 1500 rpm for 3 minutes to remove air bubbles and seat the liquid on the bottom of each well. The acoustic source plate was then placed in the acoustic dispenser and about 0.8-1 nL of each well was spotted onto the substrate in a direct one-to-one transfer maintaining the same well layout.

In a similar manner, a 100-fold dilution was tested as well as 200-fold dilution. In the 200 fold dilution test we transferred 40 nL of the 10 nM solution to a 1536 acoustic source plate. 7.960 uL of a 50% DMSO/Water 1% TFA solution was added to each well and the plate was treated in a similar manner as above and spotted onto our proprietary chip in a direct one to one transfer keeping the same well layout.

Data acquisition was performed using a Applied Biosystems 5800 TOF-TOF laser-desorption/ionization (LDI) mass spectrometer equipped with an Nd:YAG laser fired at 400 Hz and 1500-4000 laser power.

Figure 3:
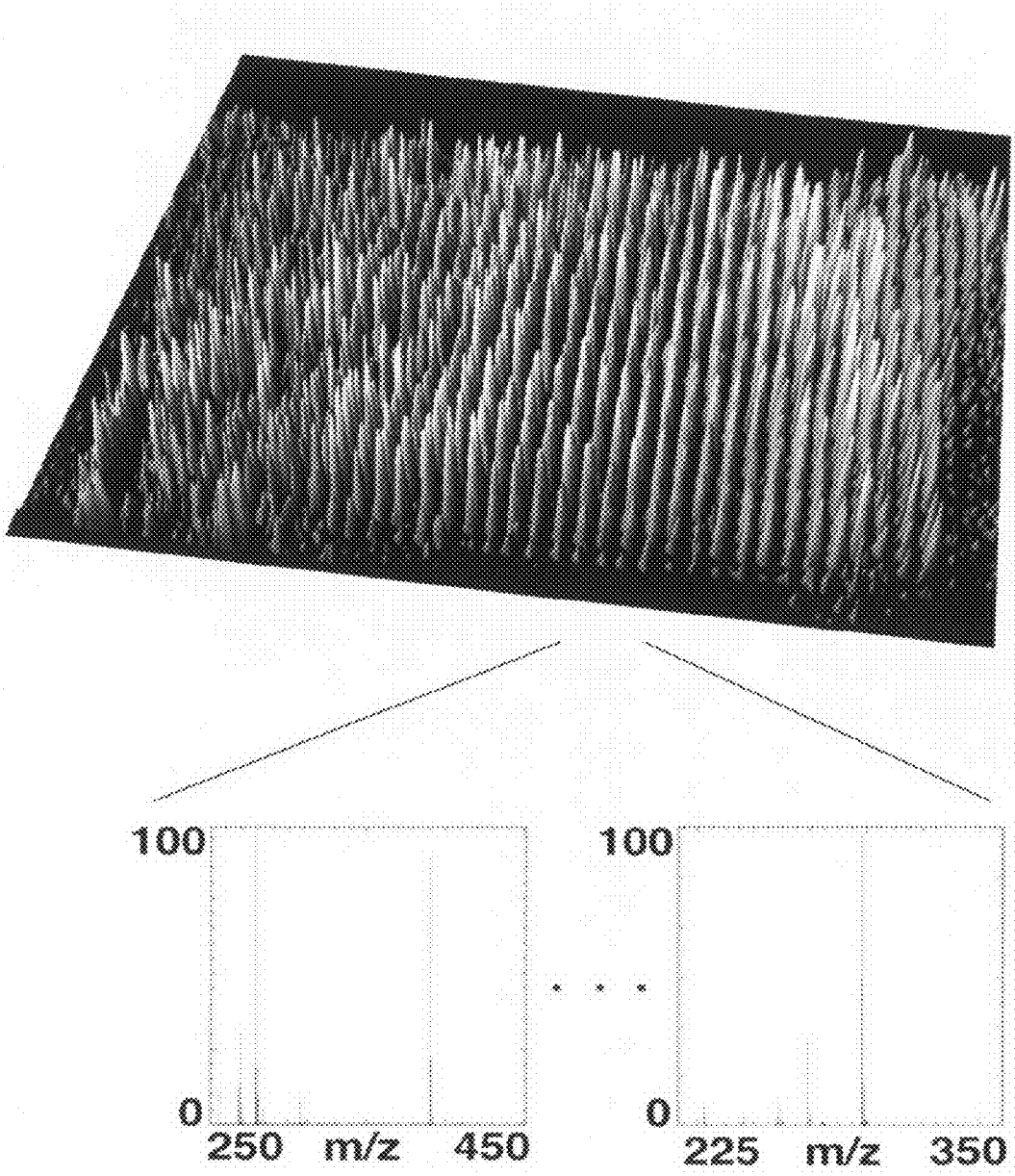
FIG. 3 shows the intensity map of the spectral data for each compound in a library analyzed at 30-fold dilution and example spectra that are generated for each compound screened.

FIG. 3 shows the intensity map of the spectral data for each compound analyzed at 30-fold dilution and example spectra that are generated for each compound screened. The generally consistent intensity of the peaks indicates consistency of ionization of compounds.

Example 3

Metabolic Profiling of Drug Activity in Single Cells

Burkitt's lymphoma-derived cells (Raji cells) were either untreated or treated with 50 rapamycin for 1 hour at 37° C. A sparse population of these cells were deposited with a pipette on the substrate at a volume of 0.50 μL with less than 100 cells contained within the spot. The surface was analyzed with scanning laser desorption mass spectrometry to produce a spectrum at each pixel scanned.

Figure 4:
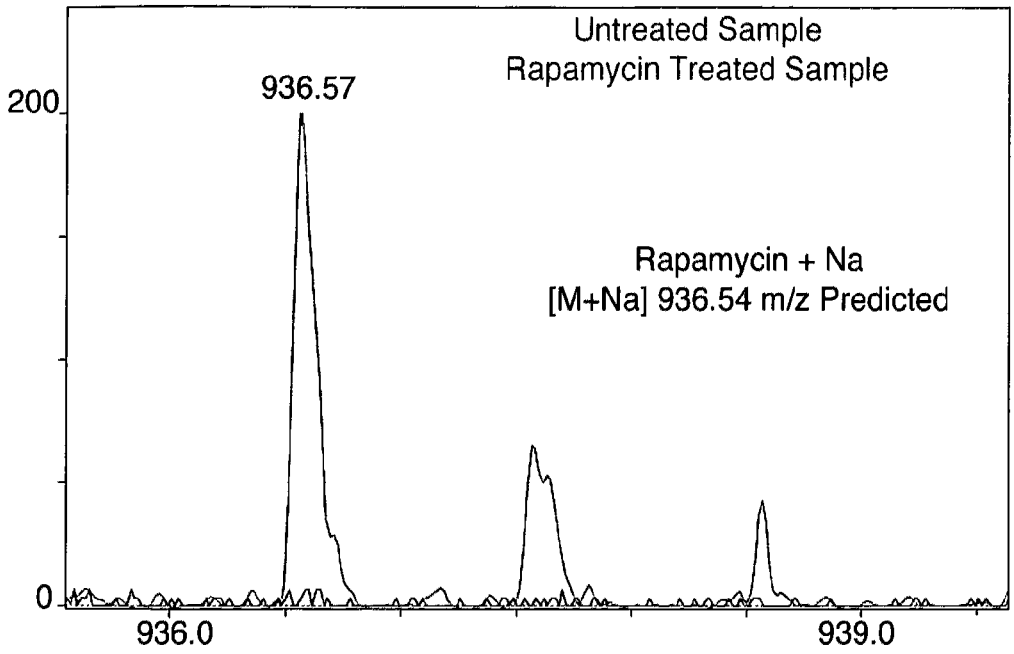
FIG. 4 shows the spectra obtained from a Raji cell sample treated with rapamycin overlaid with spectra obtained from an untreated sample.

FIG. 4 shows the spectra obtained from a treated sample overlaid with spectra obtained from an untreated sample. The drug (m/z 936.54 $(M+H)^+$) was detected in treated cells but not in the untreated sample.

Example 4

High-Throughput Liver Metabolite Profiling of Genetic Knockout Mice

Livers dissected from PNPLA3-knockout and wild type mice were each desiccated then ground to a fine homogenized powder. 1 mg of the powder was dissolved in 40% methanol, 10% chloroform and 50% water and sonicated for 5 minutes. The samples were then centrifuged at 2,000 g and the supernatant collected. 4 uL of each liver extract sample was transferred from the spiked source wells to an acoustic 1536 well plate in a 6×6 square. Yellow food coloring was prepared (300 uL to 25 mL 75% methanol/water) and added to the acoustic source plate as an index along one outlying row and one outlying column to mark the orientation of the substrate. The silicon substrate described in Example 1 was spotted in 5 nL volumes in an addressable format, in 12 multiplets to make an 18×24 spot grid with an outer edge of dye along the right side and on the bottom for orientation in the mass spectrometer instrument. The samples were analyzed with both positive and negative mode mass spectrometry across the 100-1000 m/z range. Using the data analysis algorithm described herein, the raw mass spectrometry data was processed to identify significant peaks and their location on the substrate—which corresponds to either a wild-type or knockout liver extract.

Figure 5:
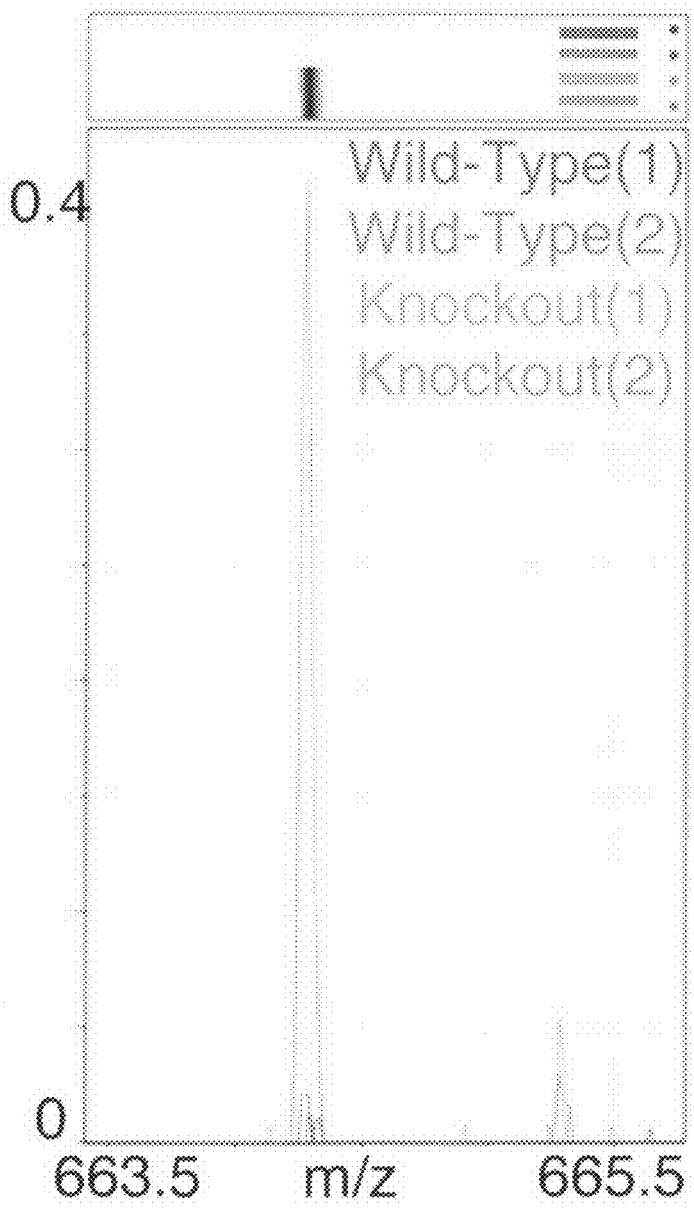
FIG. 5 shows the metabolic profile spectrum of a PNPLA3-knockout mouse liver extract overlaid with the metabolic profile spectrum from the wild type liver extract showing significant metabolic profile differences.

FIG. 5 shows the metabolic profile spectrum of a PNPLA3-knockout mouse liver extract overlaid with the metabolic profile spectrum from the wild type liver extract showing significant metabolic profile differences.

Example 5

Chemical Library Screen Using Whole-Organism Zebrafish 96 wells containing one, two or three zebrafish at the Prim-15 stage of development were treated with compounds from a small molecule library at 10 μM concentration for 1 hour. After 1 hour, growth media was drawn off and 150 μL of methanol was added to the wells and the samples were flash frozen and stored at −80° C. Frozen samples were sonicated in an ice water bath for 15 minutes and further homogenized with repeated pipetting cycles within the wells and the well plates were spun down.

4 μL of the zebrafish sample extracts in 90% methanol/chloroform were carefully decanted off the top of the well and placed in a 384 well acoustic source plate in a 10 by 10 grid. The outer columns and wells were filled with a dilute food coloring to form a 12 by 12 grid. The plate was then "stamped" into a 1536 well plate with 4 replicates using a Janus 384 well head liquid handler. The plate was centrifuged at 1500 rpm for 3 minutes to remove air bubbles and seat the liquid on the bottom of each well.

The acoustic source plate was then placed in the acoustic dispenser and approximately 1 to about 5 nL of each well was spotted onto the substrate described in Example 1 as a 24 by 24 grid with a spot area of approximately 0.008 $mm^2$. Spectra from the array spots were acquired using positive and negative mode mass spectrometry and raw data analysis was performed using the data analysis algorithm described herein.

Figure 6:
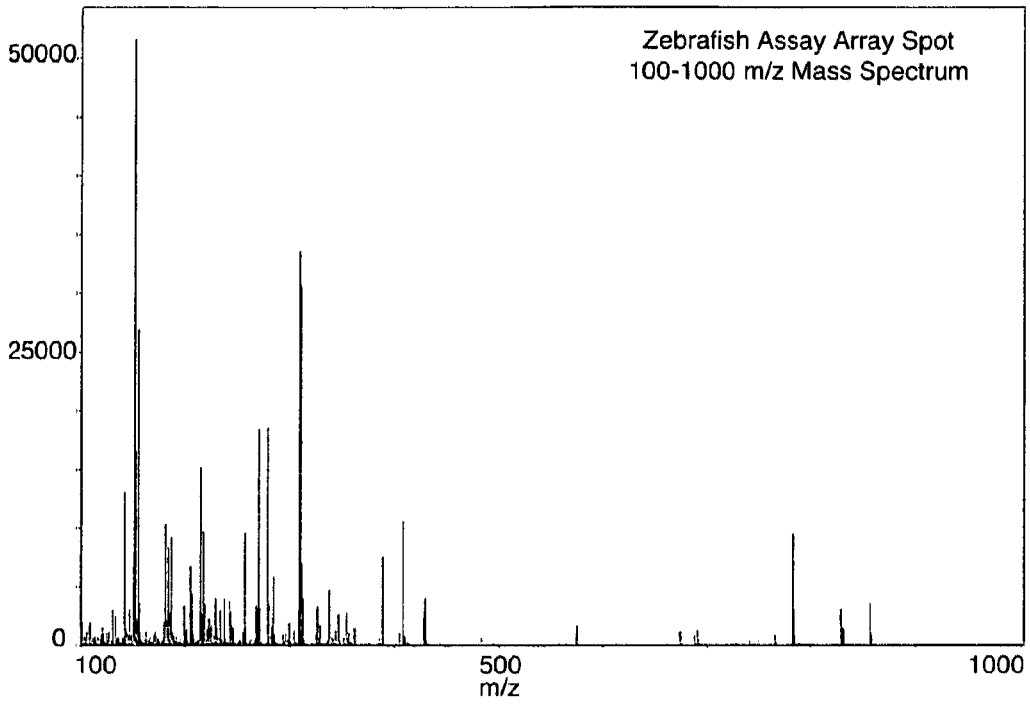
FIG. 6 shows the ionization profile of a zebrafish sample treated with a library compound detected in the 100 to 1,000 m/z range

FIG. 6 shows the metabolic profile of a zebrafish sample treated with a library compound. The sample was analyzed for detection in the 100 to 1,000 m/z range, and the spectrum was obtained in positive ionization mode. Another spectrum, not shown, was obtained in negative ionization mode.

Figure 7:
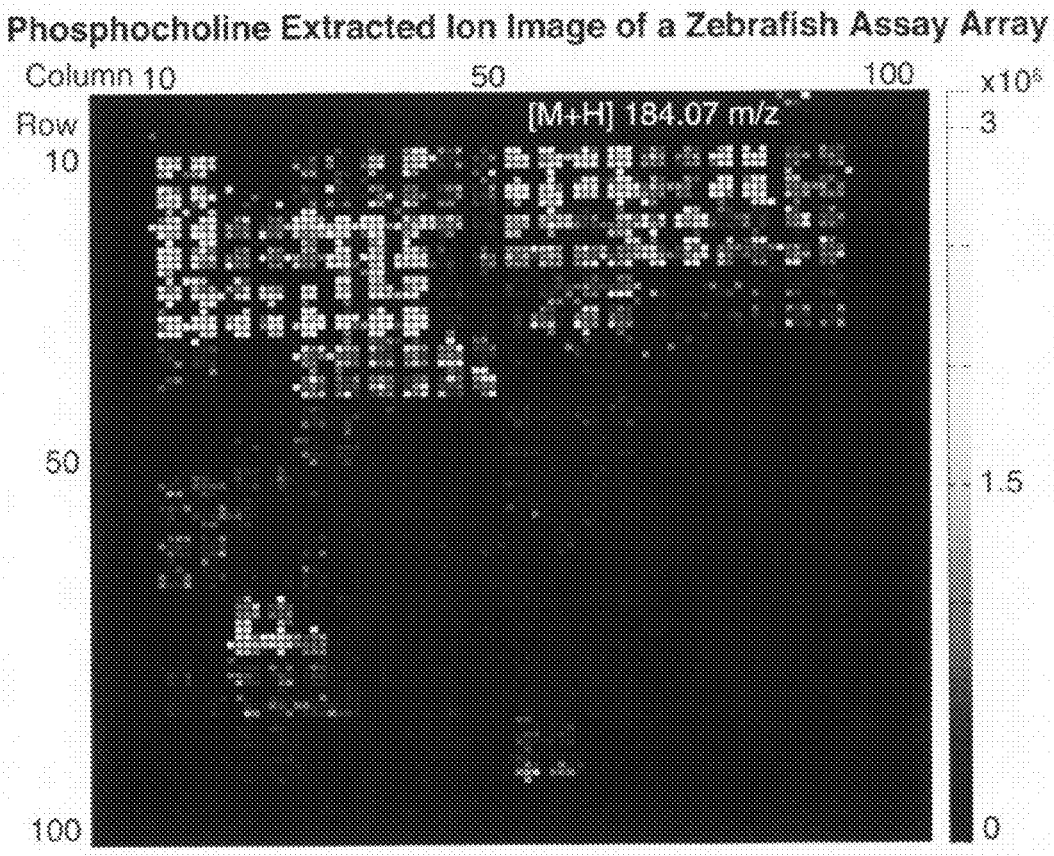
FIG. 7 shows an intensity map of a selected metabolite, phosphocoline, detected in the zebrafish whole organism across a compound library.

FIG. 7 shows an intensity map of a selected metabolite, phosphocoline, detected in the whole organism compound library screen in zebrafish. Each sample represents the phosphocoline detected in a zebrafish organism incubated with a compound from a library.

Figure 8:
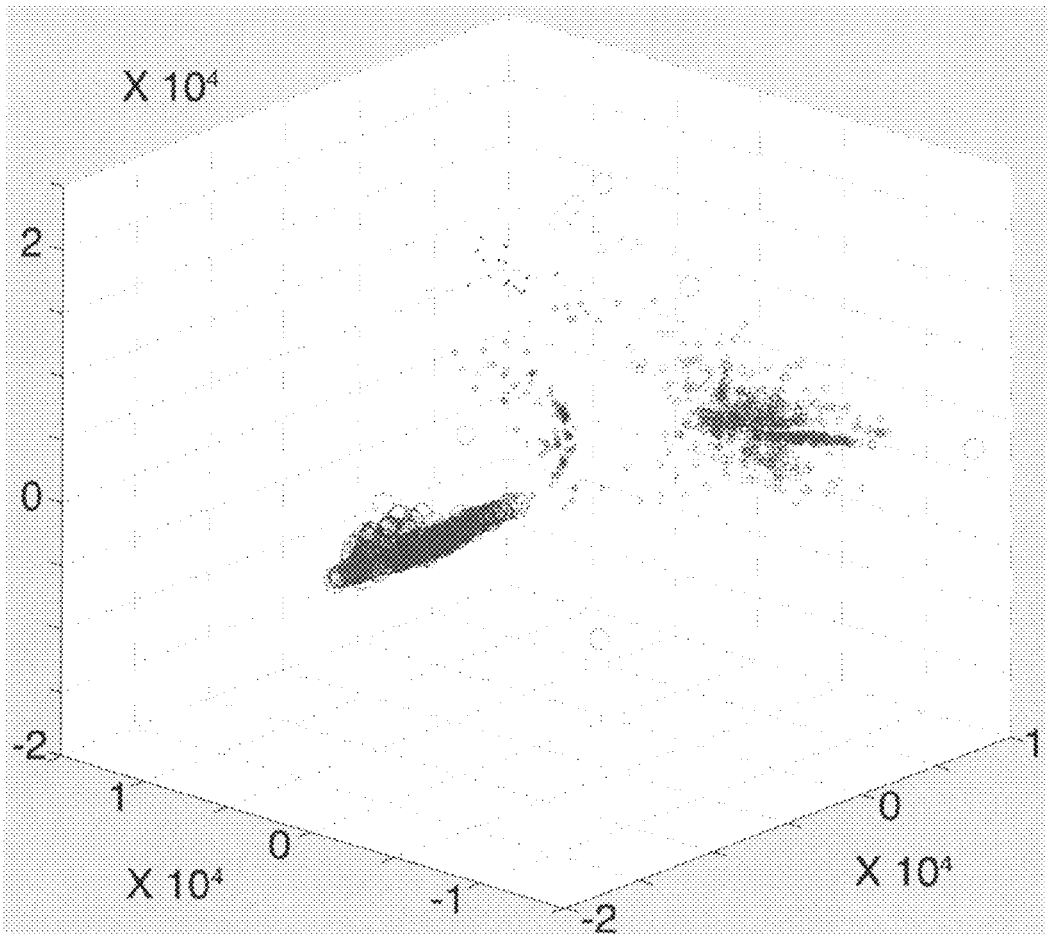
FIG. 8 shows the cluster analysis of the zebrafish array in which the spectral profiles obtained from the array were clustered using the algorithm described herein. Distinct groups of cellular or metabolic activity (outlying circles) could be distinguished from background or background activity (two main clusters of circles).

FIG. 8 shows the cluster analysis of the zebrafish array in which the spectral profile obtained from the array is clustered using the algorithm described herein. Distinct groups of cellular or metabolic activity could be distinguished from background or background activity.

All publications and patent applications mentioned in this specification are herein incorporated by reference to the same extent as if each individual publication or patent application was specifically and individually indicated to be incorporated by reference.

What is claimed is:

1. A method of detecting an analyte in a sample by desorption ionization mass spectrometry, comprising the steps of (1) depositing a plurality of matrix-free samples of differing composition, each having a volume in the picoliter to nanoliter range on a matrix-free substrate using acoustic deposition (2) delivering radiation to each said sample to cause matrix-free desorption and ionization of said samples and (3) detecting the mass-to-charge ratio of the ionized analyte from each sample.

2. The method of claim 1 wherein the sample comprises a composition selected from:

small molecule compounds, peptides, proteins, metabolites, biomolecules, cell lysates, whole cells, biofluids and tissues.

3. The method of claim 1, wherein the samples are deposited on the substrate by acoustic deposition directly from an acoustic well plate in which each sample is disposed in a separate well.

4. The method of claim 1 wherein the mass range detected is from about 70 to about 2000 Daltons.

5. The method of claim 1 wherein the mass range detected is from about 10 to about 2500 Daltons.

6. The method of claim 1 wherein the mass range detected is from about 2500 to about 50000 Daltons.

7. The method of claim 1, wherein each of the plurality of samples is deposited on a different locus on the substrate, delivering radiation to each said sample comprises delivering radiation to a plurality of substrate loci, and the method further comprises obtaining an independent measurement of mass spectrometric data from each of the plurality of substrate loci.

8. The method of claim 7, further comprising:

identifying peaks in a plurality of the independent measurements of mass spectrometric data;

aligning the peaks to correct for peak shifts due to substrate differences;

normalizing the aligned peaks; and performing clustering analysis to cluster the independent measurements by at least one statistically significant feature or attribute.

9. The method of claim 7, further comprising mapping the independent measurements to surface regions of the substrate.

* * * * *